US007347742B2

(12) United States Patent
Hall et al.

(10) Patent No.: US 7,347,742 B2
(45) Date of Patent: Mar. 25, 2008

(54) CONNECTOR ASSEMBLY INCLUDING PROVISION FOR BODY CLIP

(75) Inventors: John Wesley Hall, Harrisburg, PA (US); James Michael Raudenbush, Halifax, PA (US); Douglas John Hardy, Middletown, PA (US); Randy Paul McCraw, Mount Airy, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/218,478

(22) Filed: Sep. 2, 2005

(65) Prior Publication Data

US 2007/0054535 A1 Mar. 8, 2007

(51) Int. Cl.
*H01R 13/514* (2006.01)

(52) U.S. Cl. ..... 439/752; 439/542

(58) Field of Classification Search ..... 439/527, 439/542, 595, 752

See application file for complete search history.

(56) References Cited

U.S. PATENT DOCUMENTS

| | | | | |
|---|---|---|---|---|
| 4,750,893 | A | 6/1988 | Sueyoshi et al. | |
| 5,076,806 | A | 12/1991 | Hotea et al. | |
| 5,389,014 | A | 2/1995 | Kümpel et al. | |
| 5,437,565 | A * | 8/1995 | Atsumi et al. | 439/752 |
| 5,643,009 | A | 7/1997 | Dinkel et al. | |
| 5,839,923 | A * | 11/1998 | Yoshida | 439/752 |
| 5,934,946 | A * | 8/1999 | Nakamura | 439/752 |
| 5,967,857 | A * | 10/1999 | Okabe | 439/701 |
| 6,171,150 | B1 * | 1/2001 | Saito et al. | 439/610 |
| 6,390,859 | B2 * | 5/2002 | Furutani | 439/752 |
| 6,676,445 | B2 | 1/2004 | Hall et al. | |
| 6,743,051 | B2 | 6/2004 | Hayashi | |
| 6,780,045 | B2 | 8/2004 | Shuey et al. | |
| 6,824,403 | B2 | 11/2004 | Hall et al. | |
| 6,893,277 | B2 | 5/2005 | Parrish et al. | |
| 6,902,443 | B2 * | 6/2005 | Hara et al. | 439/752 |
| 7,048,581 | B1 * | 5/2006 | Wong | 439/595 |

OTHER PUBLICATIONS

Tyco Electronics, Drawing No. 14885C2, Plug Kit, Unassembled, 2 pgs. (available at least as early as Sep. 1, 2004).
Tyco Electronics, Drawing No. 14885C9, Jack Kit, Unassembled, 2 pgs. (available at least as early as Sep. 1, 2004).
Amphenol RF engineering Drawing No. FA3-141P-X, "Locking 3 Position", 1 pg., approved Sep. 26, 2003.
Amphenol RF engineering Drawing No. FA3-141J-X, "Locking 3 Position", 1 pg., approved Sep. 26, 2003.

* cited by examiner

*Primary Examiner*—Thanh-Tam Le

(57) ABSTRACT

An electrical connector assembly including a housing and a retainer releasably supported by the housing is provided. The retainer includes a clip receiver configured to retain a supporting clip and a lock configured to engage an electrical connector for restricting axial movement thereof relative to the housing.

12 Claims, 13 Drawing Sheets

CONNECTOR ASSEMBLY INCLUDING PROVISION FOR BODY CLIP

BACKGROUND AND SUMMARY OF THE INVENTION

The present invention relates generally to electrical connectors and, more particularly, to a connector lock including a body clip provision.

Radio frequency (RF) coaxial cable connector assemblies have been used for numerous automotive applications, such as global positioning systems (GPS), car radios, mobile phones, airbag systems, and multimedia devices. Such connector assemblies are often secured relative to an automotive component, such as a door or a roof panel, through the use of a body clip.

Conventional coaxial cables typically consist of an outer conductor, an inner conductor, a dielectric, and a jacket. The outer conductor and the inner conductor of the cable often electrically interface with a mating coaxial cable through jack and plug connectors. Such conventional coaxial cable connectors are known in the art, for example, in U.S. Pat. Nos. 6,676,445 and 6,824,403, which are assigned to the assignee of the present invention and are expressly incorporated by reference herein.

Typical electrical connector assemblies have retention means in a connector housing in order to secure the electrical connectors within the connector housing. One such retainer is a plastic movable member which is configured to move in place over the connector to lock the connector in place within the connector housing. Some of such movable members are moved transversely to the axial direction, while others are designed as hinged flaps which are rotated into place.

The connector housing often further includes an integrally formed clip provision which is configured to releasably retain the body clip. As noted above, the body clip is typically configured to secure the position of the connector assembly relative to an automobile component.

In order to standardize various types of connectors and thereby avoid confusion, certain industry standards have been established. One of these standards is referred to as FAKRA. FAKRA is the Automotive Standards Committee in the German Institute for Standardisation, representing international standardization interests in the automotive field. The FAKRA standard provides a system, based on keying and color coding, for proper connector attachment. Like jack keys can only be connected to like plug keyways in FAKRA connectors. Secure positioning and locking of connector housings is facilitated by way of a FAKRA defined catch on the jack housing and a cooperating latch on the plug housing.

According to an illustrative embodiment of the present disclosure, an electrical connector assembly includes a jack housing having a first side, a second side, and an axial passageway configured to receive an electrical connector jack. A plug housing includes a first side, a second side, and an axial passageway configured to receive an electrical connector plug for mating with the electrical connector jack. A retainer includes a first leg, a second leg, a bridge member connecting the first leg and the second leg, and a clip receiver configured to retain a supporting clip. A first coupler is supported by the jack housing and is configured to releasably couple the retainer to the jack housing. A second coupler is supported by the plug housing and is configured to releasably couple the retainer to the plug housing, wherein the retainer may be alternatively coupled to the jack housing and the plug housing.

According to a further illustrative embodiment of the present disclosure, an electrical connector assembly includes a housing having an axial passageway and a transverse passageway. An electrical connector is configured to be received within the axial passageway. The electrical connector includes a shell having a shoulder. A retainer is releasably coupled to the housing and includes a clip receiver configured to retain a supporting clip. A lock is configured to be received within the transverse passageway and to engage the shoulder of the electrical connector for restricting axial movement of the electrical connector relative to the housing.

According to yet another illustrative embodiment of the present disclosure, a retainer is configured to be releasably coupled to an electrical connector housing. The retainer includes a first leg having an opening configured to receive a first latch supported by a first side of the electrical connector housing, and a second leg including an opening configured to receive a second latch supported by a second side of the electrical connector housing. A bridge member connects the first leg and the second leg, and includes a lower surface and an upper surface. A clip receiver is supported by the lower surface of the bridge member and is configured to retain a supporting clip. A lock is supported by the upper surface of the bridge member and is configured to restrict movement of an electrical connector received within the housing.

DESCRIPTION OF THE PREFERRED EMBODIMENT

Figure 1:
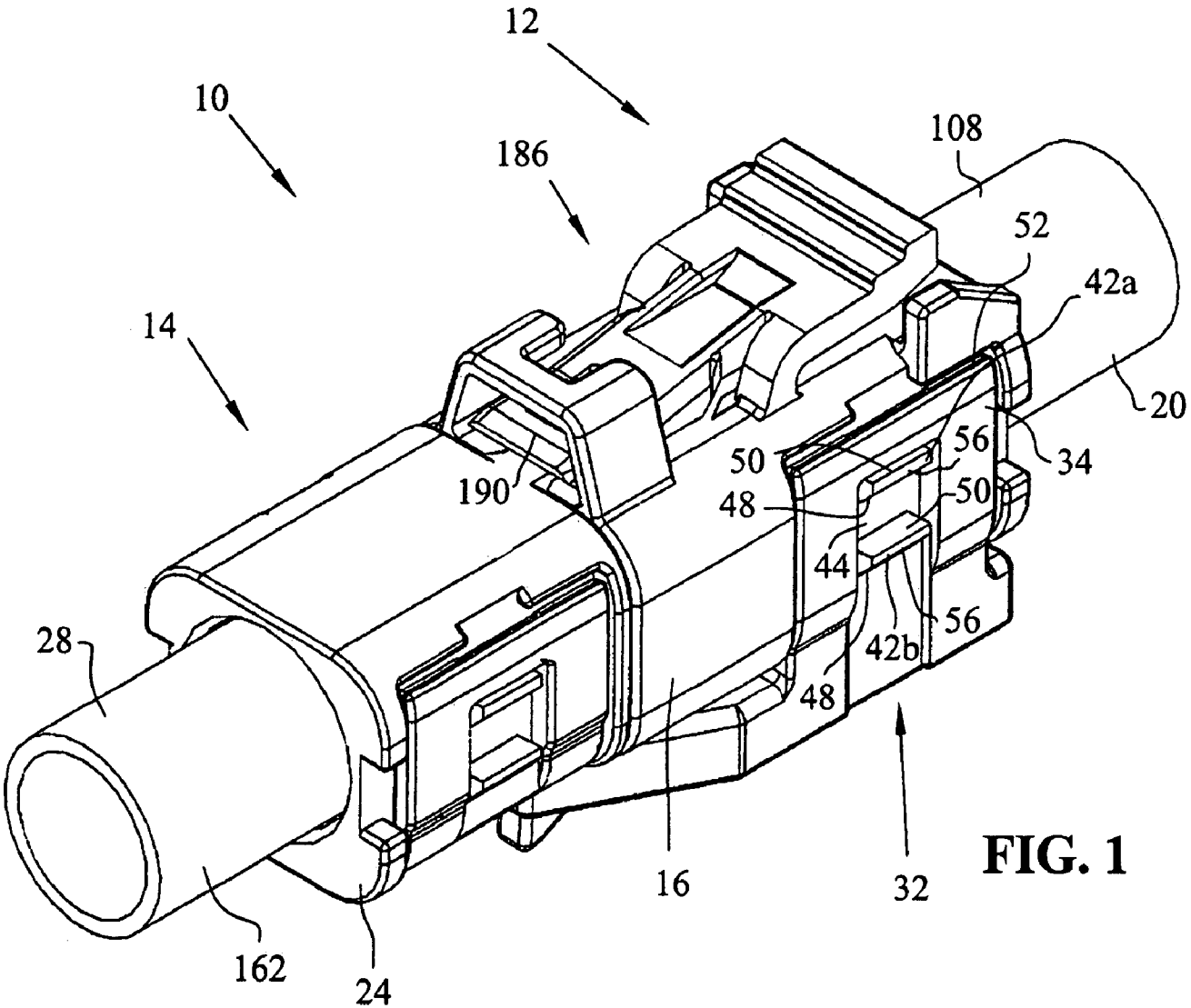
FIG. 1 is a perspective view of an illustrative embodiment electrical connector assembly of the present disclosure.
Figure 2:
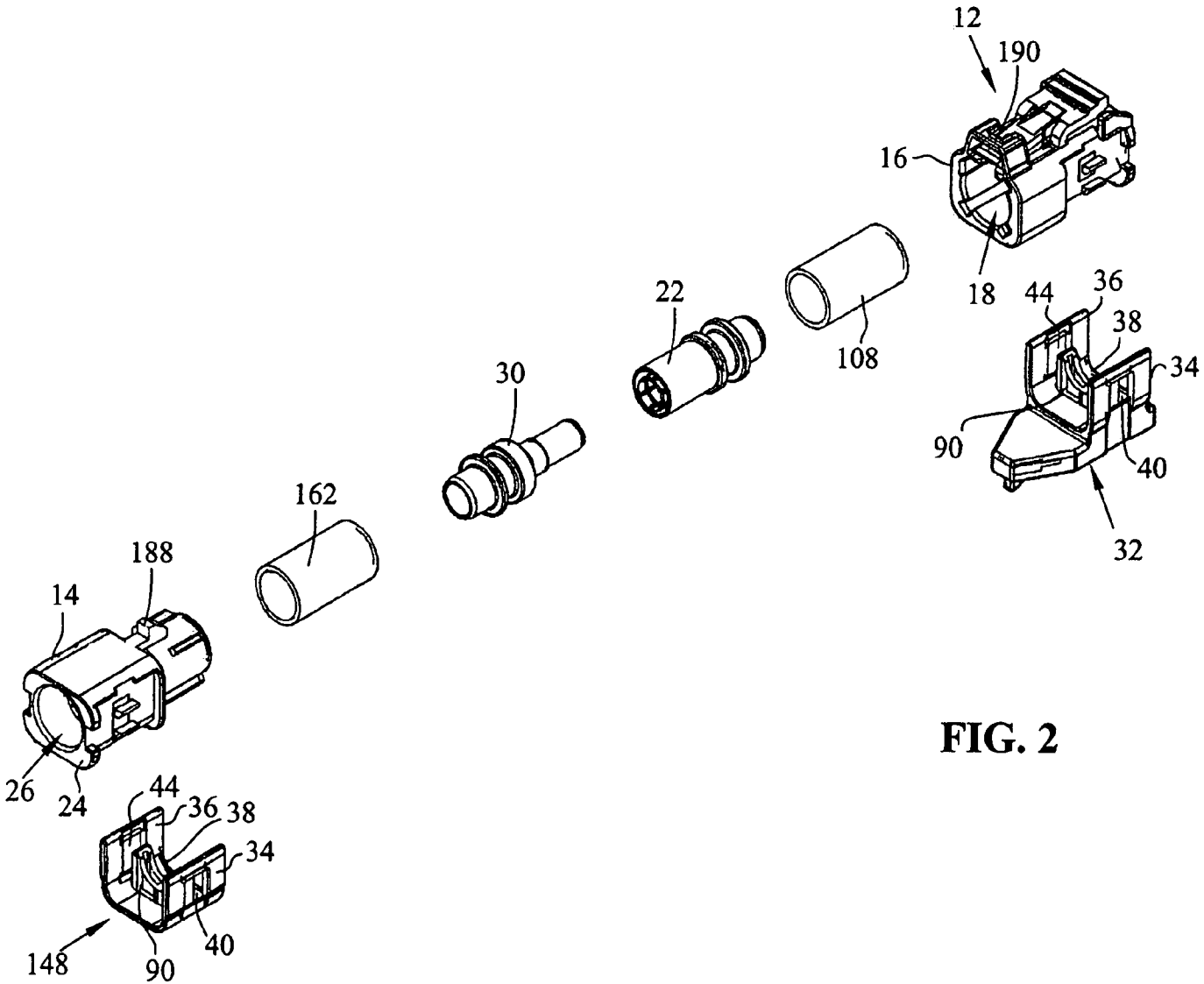
FIG. 2 is a partially exploded perspective view of the electrical connector assembly of FIG. 1.
Figure 3:
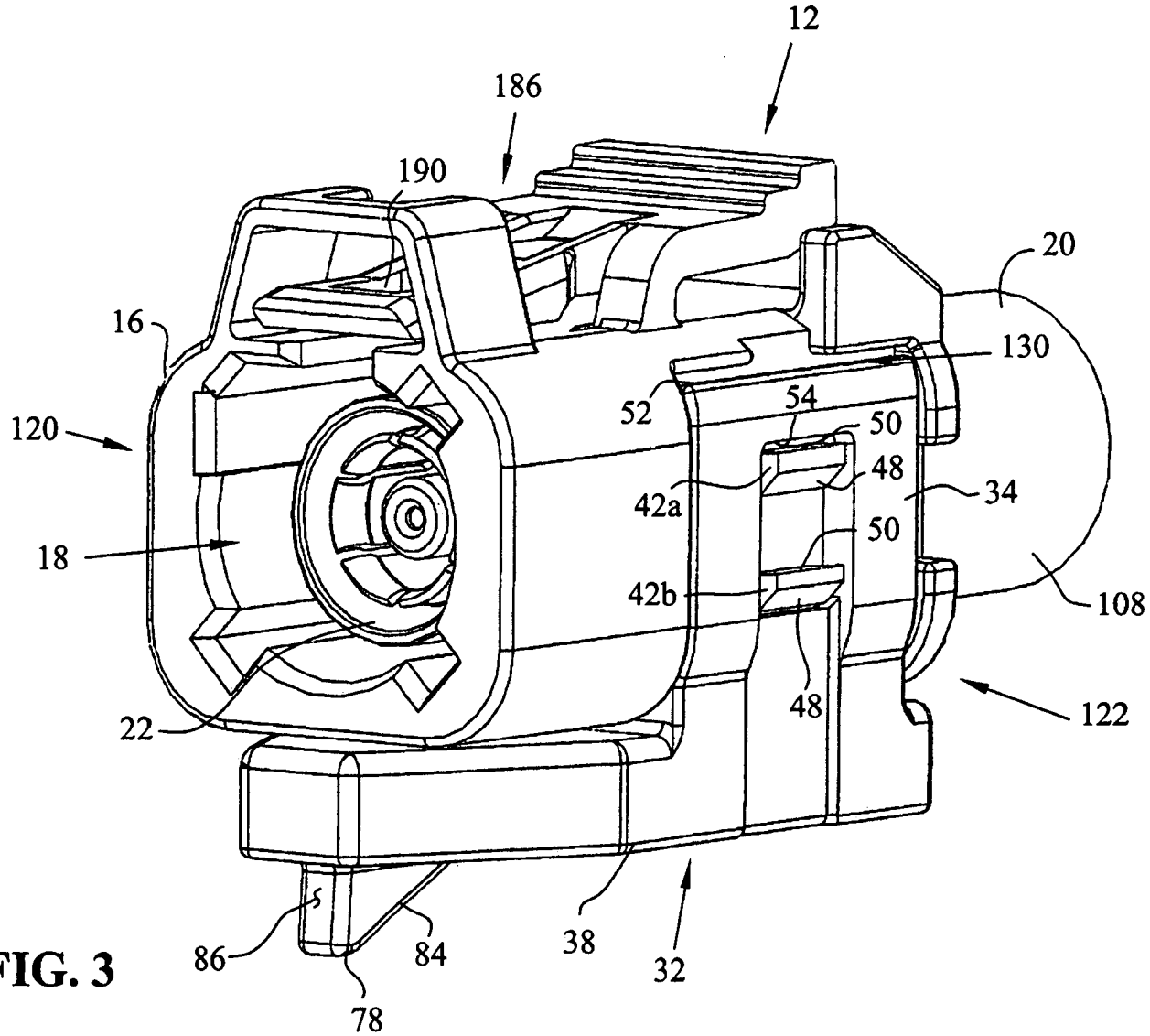
FIG. 3 is a first perspective view of an illustrative embodiment plug assembly.
Figure 4:
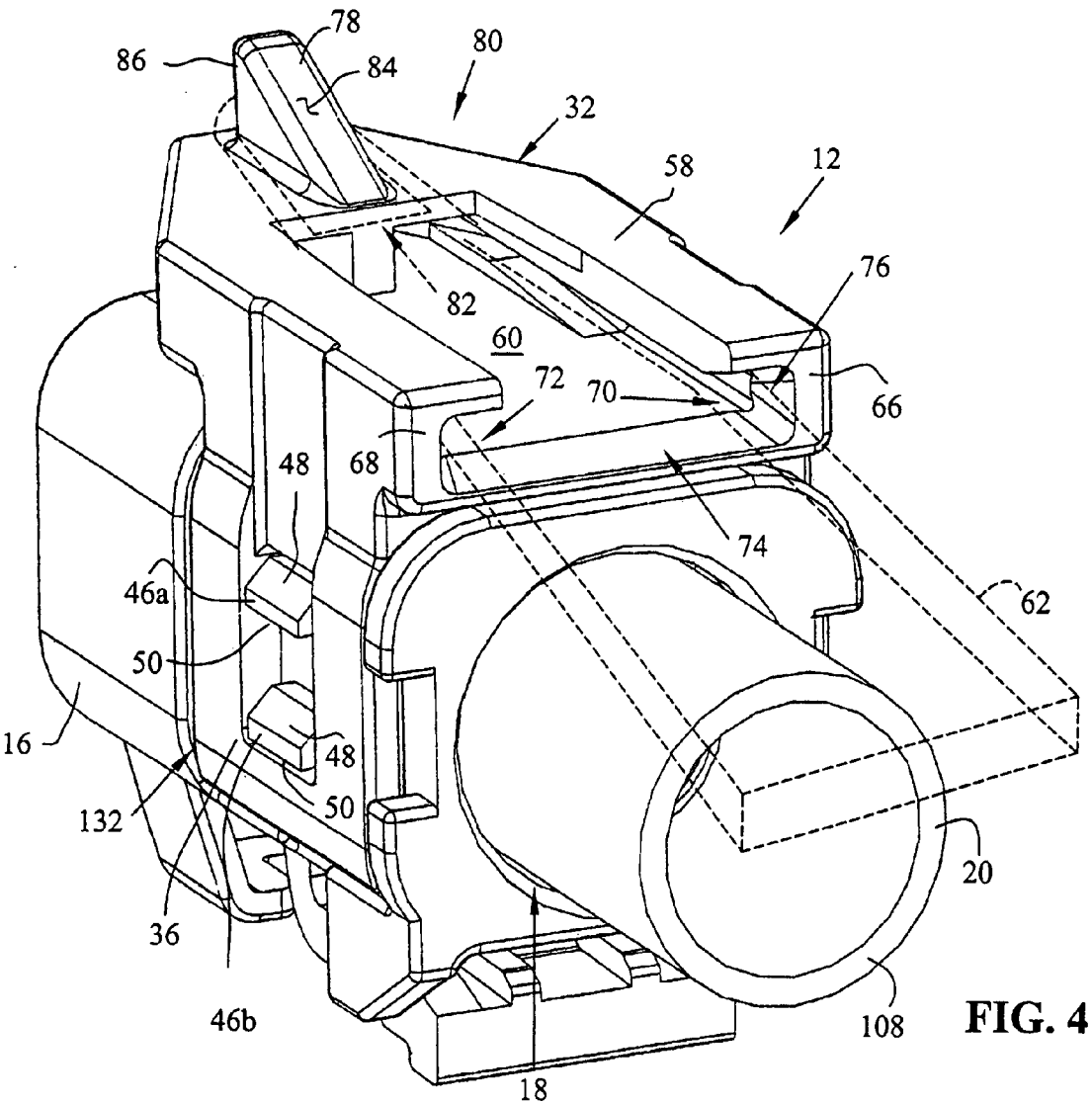
FIG. 4 is a second perspective view of the plug assembly of FIG. 3.

Referring initially to FIGS. 1-5, an electrical connector assembly 10 according to the present disclosure includes a plug assembly 12 which is configured to couple to a jack assembly 14. The plug assembly 12 includes a plug housing 16 having an axial passageway 18 which is configured to receive a coaxial cable 20 (FIGS. 3 and 4). The coaxial cable 20 illustratively includes a conventional plug connector 22 (FIGS. 2 and 3).

Figure 6:
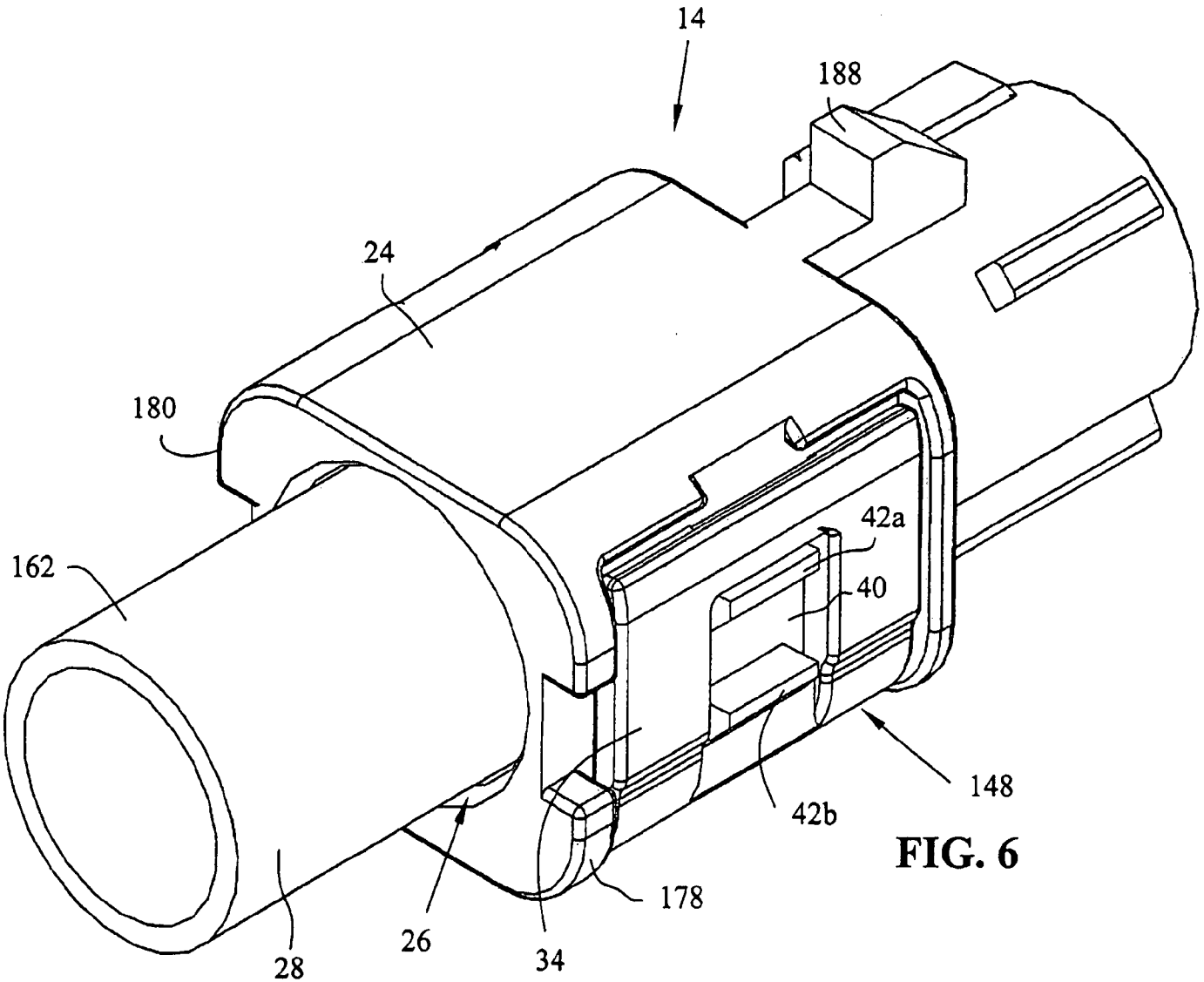
FIG. 6 is a first perspective view of an illustrative embodiment jack assembly.
Figure 7:
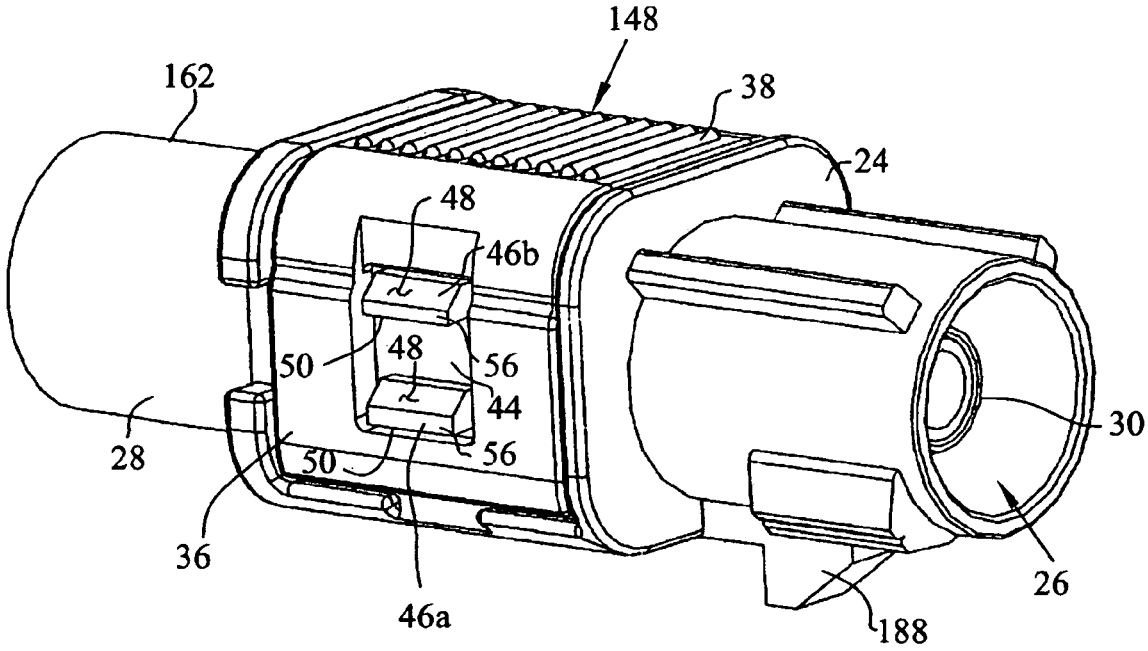
FIG. 7 is a second perspective view of the jack assembly of FIG. 6.

With reference to FIGS. 1, 2, and 6-8, the jack assembly 14 similarly includes a jack housing 24 having an axial passageway 26 which is configured to receive a coaxial cable 28 (FIGS. 6 and 7). The coaxial cable 28 includes a conventional jack connector 30 which is configured to mate with the corresponding plug connector 22 and provide an electrical connection between respective cables 20 and 28 (FIG. 2).

With reference now to FIGS. 2, 3, 9, and 10, a generally U-shaped retainer 32 is configured to releasably couple to either the plug housing 16 or the jack housing 24. In other words, the retainer 32 may be alternatively coupled to either the plug housing 16 or the jack housing 24 depending upon the environment and application requirements of the connector assembly 10. In certain applications, two retainers 32 may be provided, one for each of the plug housing 16 and the jack housing 24. The retainer 32 includes a first leg 34 extending substantially parallel to a second leg 36. A bridge member 38 connects the first leg 34 and the second leg 36.

The first leg 34 includes a first opening, illustratively first slot 40 configured to releasably receive a first coupler, illustratively upper and lower first latches 42*a* and 42*b* supported by the plug housing 16. Similarly, the second leg 36 includes a second opening, illustratively second slot 44 configured to releasably receive a second coupler, illustratively upper and lower second latches 46*a* and 46*b* supported by the plug housing 16. The latches 42 and 46 each include an inclined ramp surface 48 and a locking surface 50. The ramp surface 48 is configured to facilitate installation of the retainer 32 on the respective housing 16, 24. More particularly, a leading edge 52 of each leg 34 and 36 passes over the ramp surface 48 until a locking edge 54 passes over the apex 56 and locks in place. The locking edge 54 "snap-fits" over the latch 42, 46 and is retained in position by engaging the locking surface 50.

The upper latches 42*a* and 46*a* provide for locking of the retainer 32 in a fully assembled position, while the lower latches 42*b* and 46*b* provide for locking of the retainer 32 in a pre-staged position. In the pre-staged position, the retainer 32 is coupled to the respective housing 16, 24 but is not operably coupled to the cable 20, 28. By providing a pre-staged position, the number of separated components for final assembly may be reduced.

A clip receiver 58 is supported by a lower surface 60 of the bridge member 38 (FIG. 9) and is configured to retain a conventional supporting clip 62 (FIG. 4). The supporting clip 62 is illustratively coupled to an automotive component (not shown), such as a door or a roof panel. The clip receiver 58 includes first and second walls 66 and 68 having slots 70 and 72 formed therein. The slots 70 an 72 define a channel 74 having a first open end 76 configured to slidably receive the clip 62. A latch 78 is positioned at the second end 80 of the channel 74 and is configured to be received within an opening 82 formed within the clip 62. The latch 78 illustratively includes a ramp surface 84 and a locking surface 86. The clip 62 is configured to glide over the ramp surface 84 and then latches in place over the locking surface 86.

Figure 9:
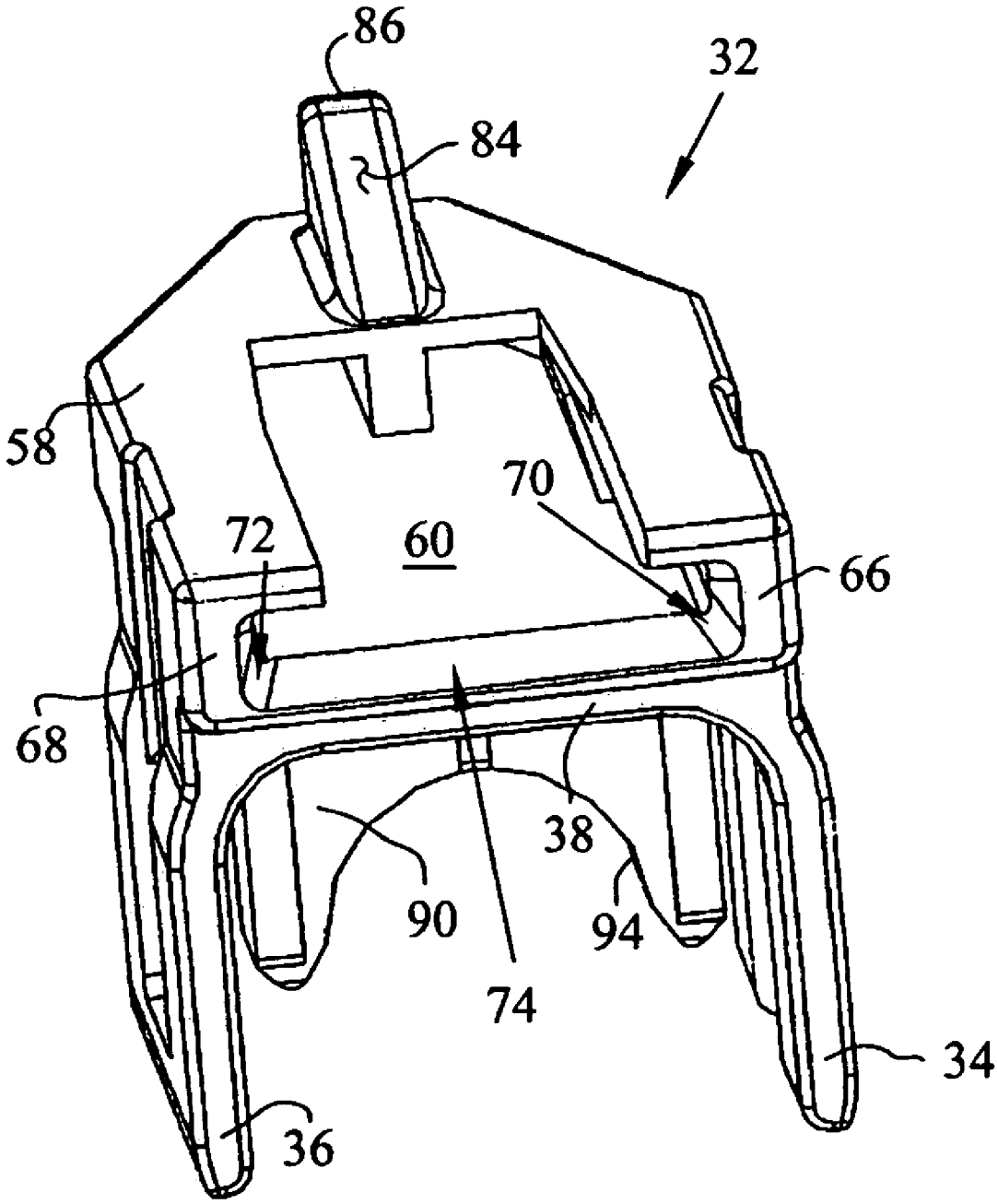
FIG. 9 is a first perspective view of an illustrative embodiment retainer.
Figure 10:
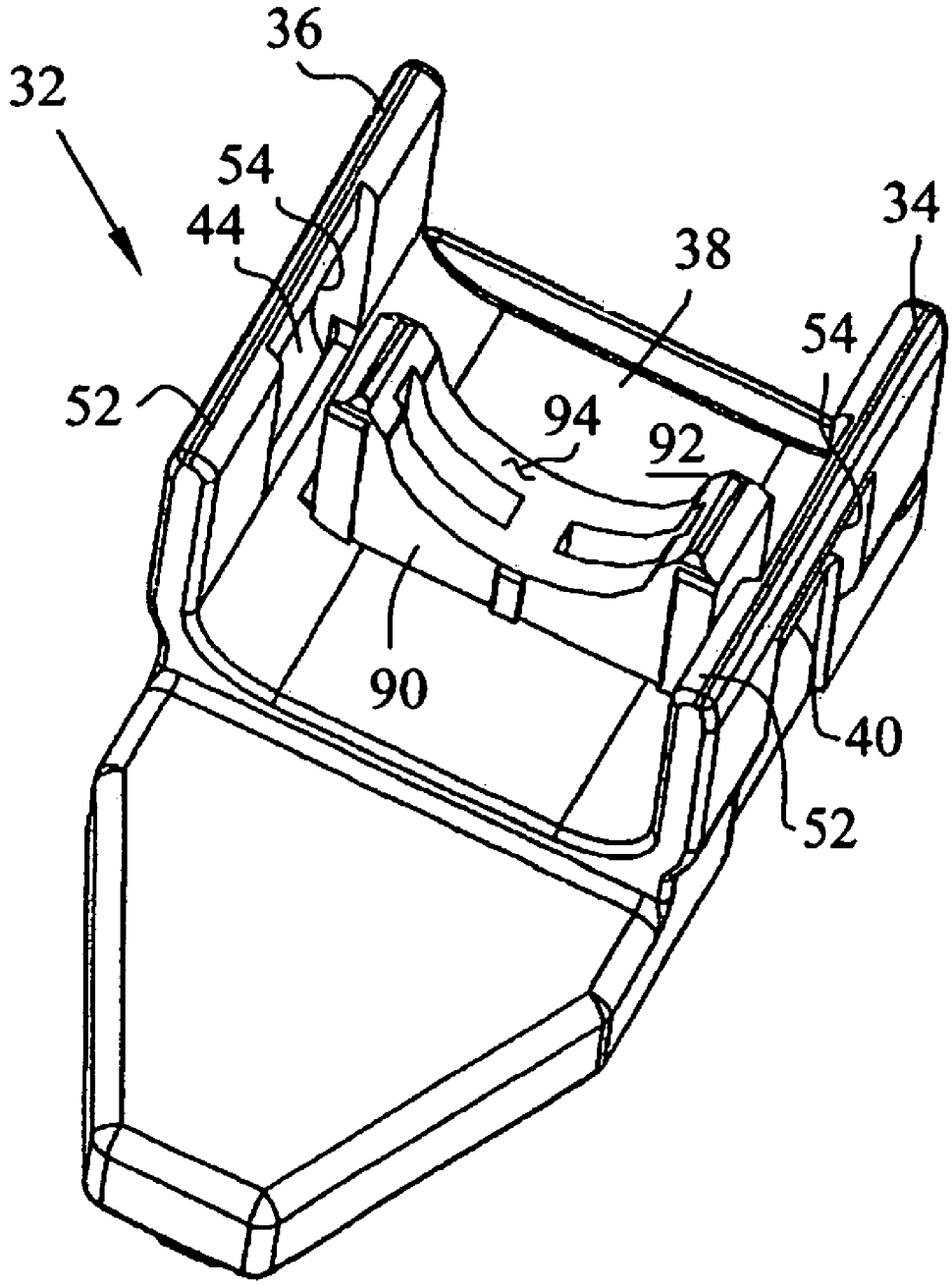
FIG. 10 is a second perspective view of the retainer of FIG. 9.
Figure 11:
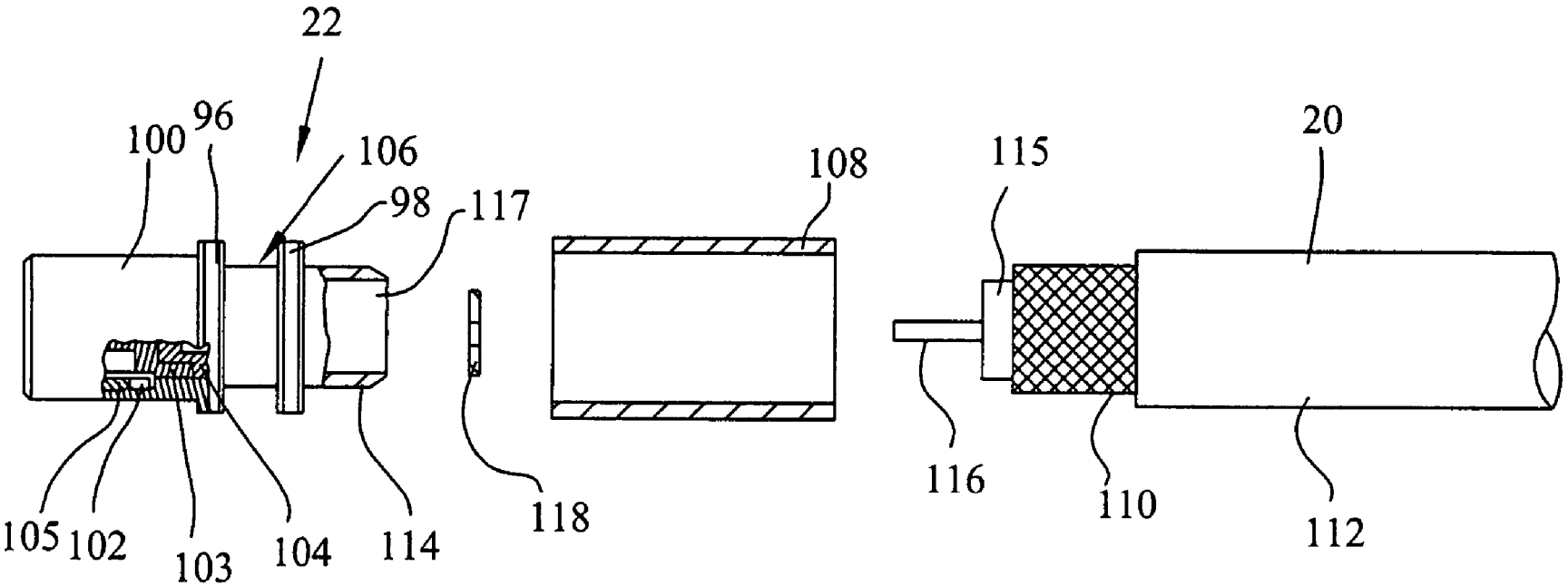
FIG. 11 is an exploded side elevational view, in partial cross-section, of a plug connector, a ferrule, and a coaxial cable.
Figure 12:
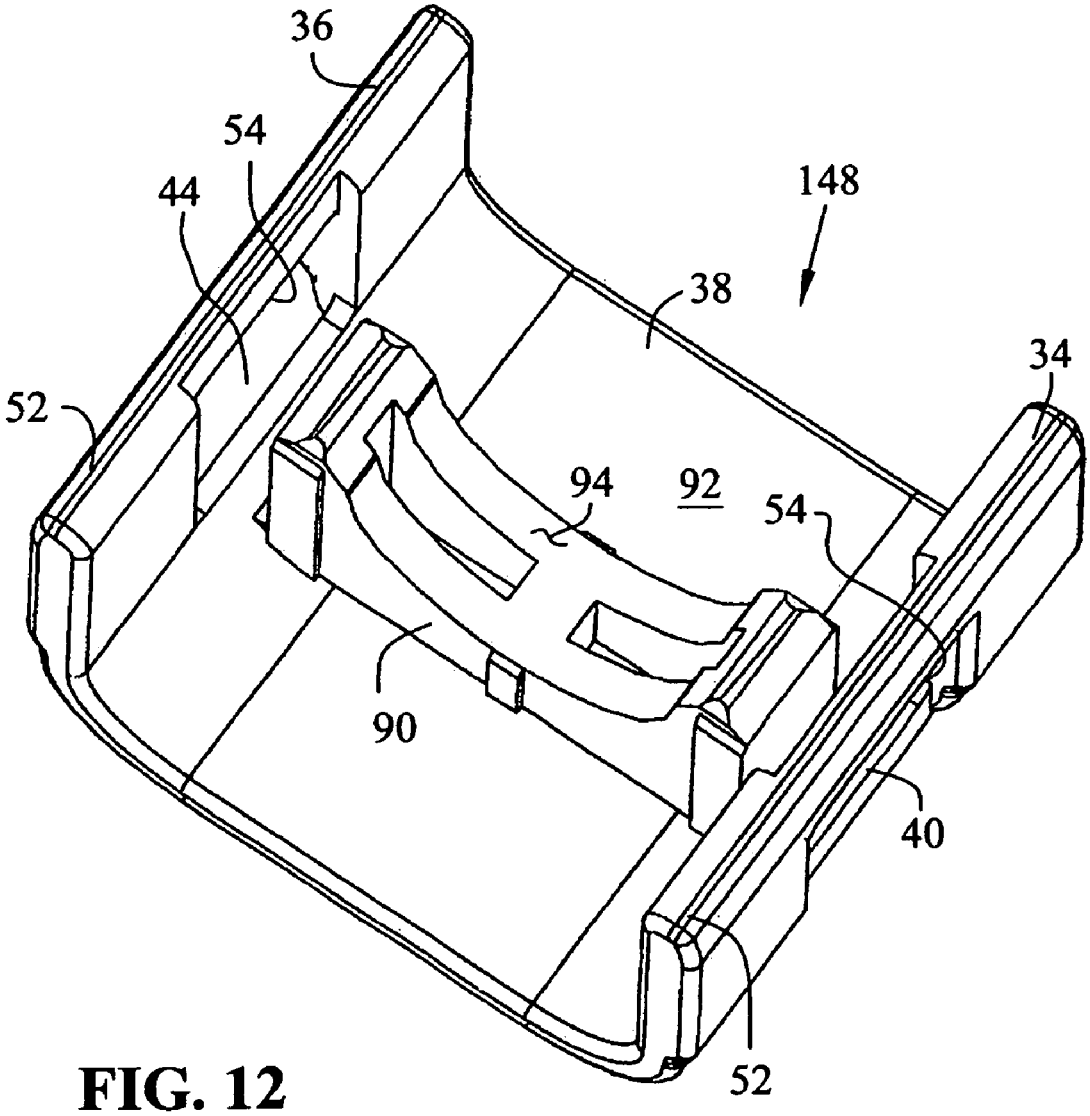
FIG. 12 is a perspective view of a further illustrative embodiment retainer without a clip receiver.
Figure 13:
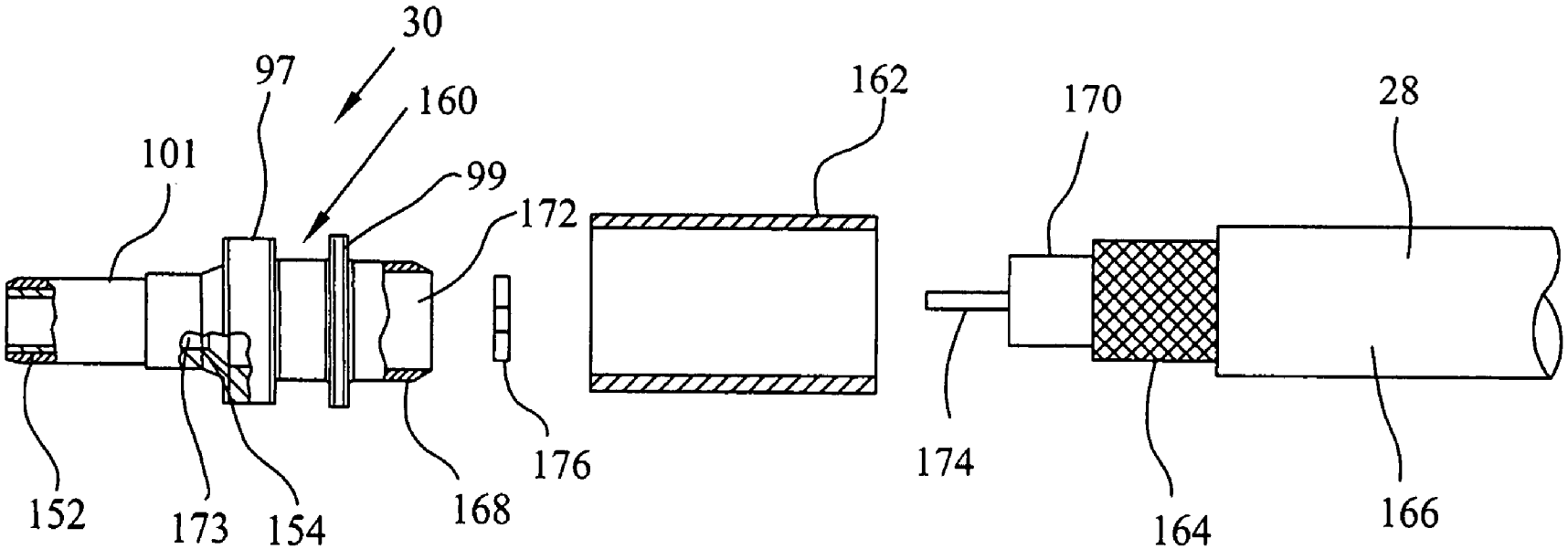
FIG. 13 is an exploded side elevational view, in partial cross-section, of a jack connector, a ferrule, and a coaxial cable.

With reference to FIGS. 9, 10, and 12, a flange or lock 90 extends upwardly from an upper surface 92 of the bridge member 38. The lock 90 includes an arcuate engagement surface 94 configured to engage one of the jack connector 22 and the plug connector 30 for restricting axial movement thereof. More particularly, the engagement surface 94 is configured to be received intermediate first and second flanges or shoulders 96, 97, and 98, 99 extending outwardly from a shell 100, 101 of the respective connector 22, 30 (FIGS. 11 and 13).

With reference to FIG. 11, the outer shell 100 of the plug connector 22 receives traditional coaxial components including a retaining ring 102, a front dielectric 103, a rear dielectric 104, and an outer contact 105. As known, the front dielectric 103 and the rear dielectric 104 may be replaced with a single dielectric. An annular groove 106 is defined intermediate the shoulders 96 and 98. A cylindrical ferrule 108 extends outwardly from the shell 100 and is configured to help retain the coaxial cable 20. More particularly, the outer conductor 110 of the coaxial cable 20 is received within a jacket 112 and is coupled between a cylindrical mount 114 of the shell 100 and the mating ferrule 108. Cable dielectric 115 passes into an interior bore 117. Inner conductor 116 of cable 20 is crimped and/or soldered to a socket contact (not shown) of the plug connector 22 in a conventional manner, and passes through the interior bore 117. An annular spacer or washer 118 may be positioned within the bore 112 for cooperating with the cable dielectric 115.

Figure 5:
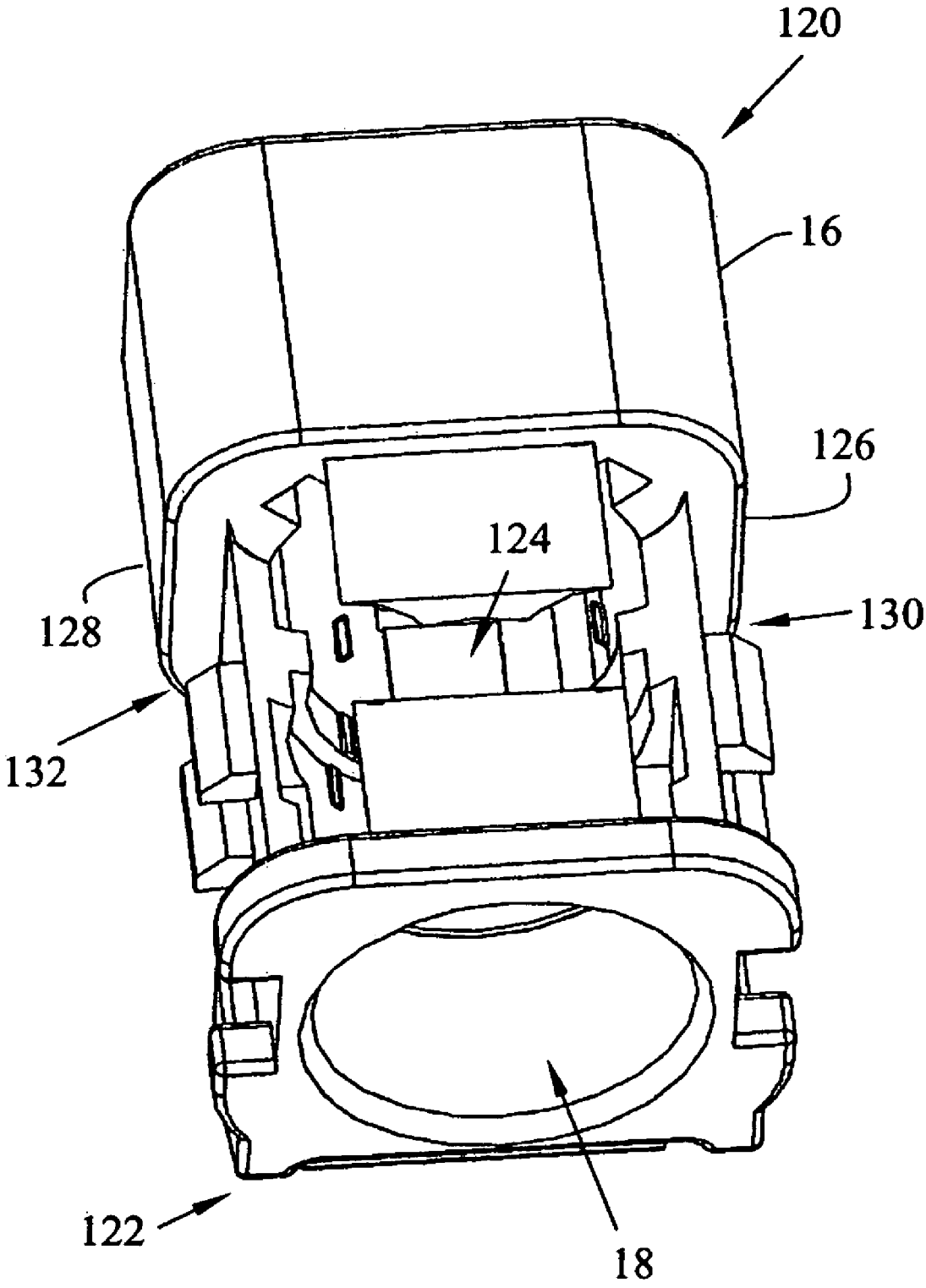
FIG. 5 is a perspective view of an illustrative embodiment plug housing.

With further reference to FIG. 5, the plug housing 16 includes a front mating end 120 and a rear connector receiving end 122. The axial passageway 18 is substantially cylindrical and is in communication with a transversely extending slot 124. The slot 124 is configured to slidably receive the lock 90. The first side 126 and the second side 128 of the housing 16 include recesses 130 and 132, respectively, to cooperate with the legs 34 and 36 of the retainer 32. The first leg 34 is received within the first recess 130 and the second leg 36 is received within the second recess 132.

Figure 8:
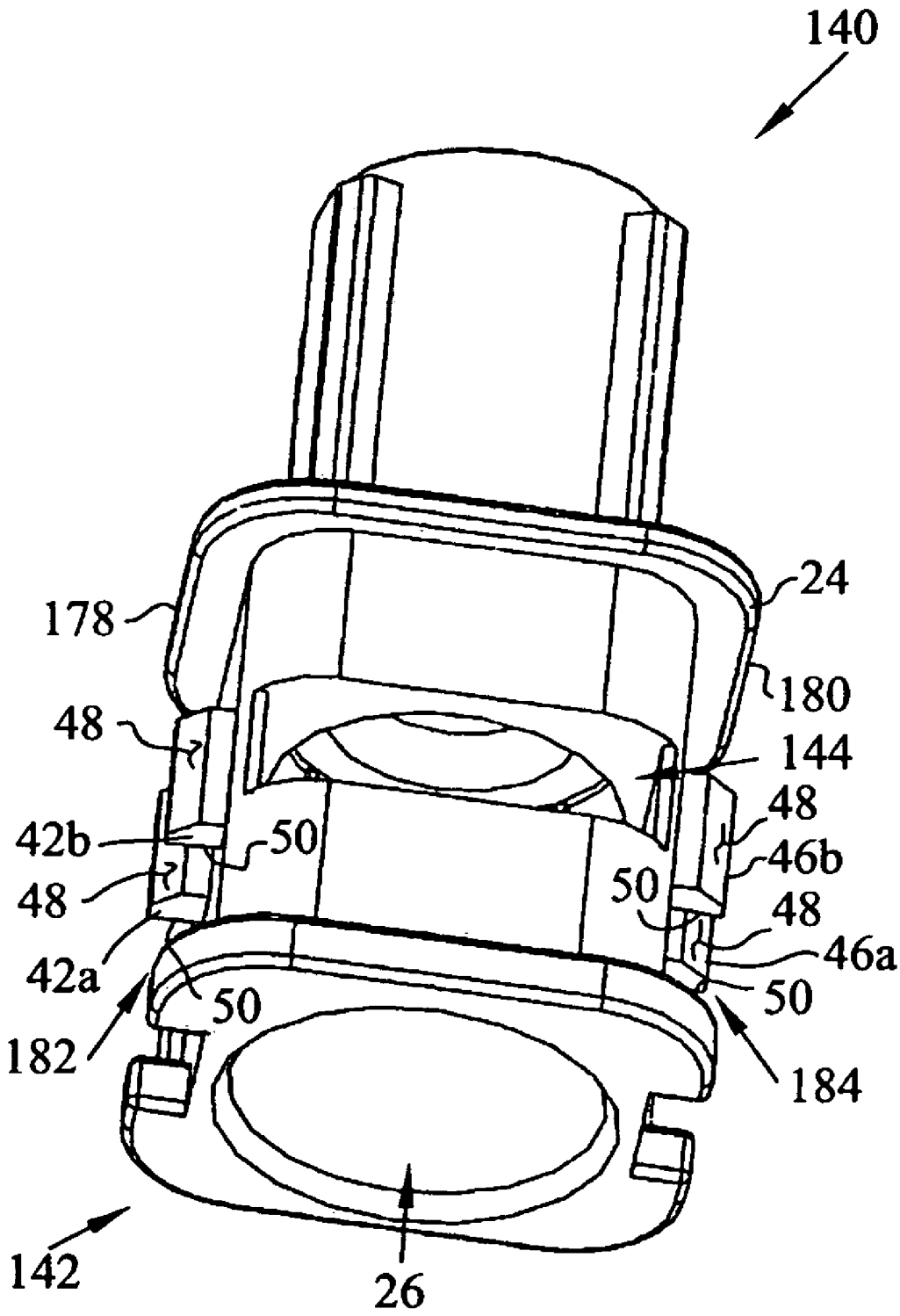
FIG. 8 is a perspective view of an illustrative embodiment jack housing.

With reference to FIG. 8, the jack housing 24 includes a front mating end 140 and a rear connector receiving end 142. The passageway 26 is substantially cylindrical and is in communication with a transversely extending slot 144. The slot 144 is configured to slidably receive the lock 90 of a retainer 148.

While in the illustrative embodiment, the plug housing 16 is shown as receiving the retainer 32 and the jack housing 24 is shown as receiving the retainer 148, it should be appreciated that the retainers 32 and 148 are interchangeable between the plug and jack assemblies 12 and 14.

As shown in FIG. 12, retainer 148 is similar to retainer 32 detailed herein. Moreover, the retainer 148 includes first and second legs 34 and 36 connected by bridge member 38. The retainer 148 also includes lock 90 extending from upper surface 92 of bridge member 38 and including arcuate engagement surface 94. However, retainer 148 does not include the clip receiver 58.

With reference to FIG. 13, the outer shell 101 of the jack connector 30 receives traditional coaxial components including a front dielectric 152 and a rear dielectric 154. As known, the front dielectric 152 and the rear dielectric 154 may be replaced with a single dielectric. Flanges or shoulders 97 and 99 define an annular groove 160 which is configured to receive the lock 90. A cylindrical ferrule 162 extends outwardly from the shell 101 and is configured to help retain the coaxial cable 28. More particularly, the outer conductor 164 of the coaxial cable 28 is received within a jacket 166 and is coupled between a cylindrical mount 168 of the shell 101 and the mating ferrule 162. Cable dielectric 170 passes into an interior bore 172. Inner conductor 174 of cable 28 is crimped and/or soldered to a pin contact (not shown) of the jack connector 30 in a conventional manner, and passes through the interior bore 172. An annular spacer or washer 176 may be positioned within the bore 172 for cooperating with the cable dielectric 170.

With further reference to FIG. 8, the jack housing 24 includes a first coupler, illustratively upper and lower first latches 42*a* and 42*b*, which are substantially the same as latches 42*a* and 42*b* of the plug housing 16 and are configured to be received within first slot 40 of the retainer 148. Likewise, the jack housing 24 includes a second coupler, illustratively upper and lower second latches 46*a* and 46*b*, which are substantially the same as latches 46*a* and 46*b* of the plug housing 16 and are configured to be received within second slot 44 of the retainer 148. The first side 178 and the second side 180 of the housing 24 include recesses 182 and 184, respectively, to cooperate with the legs 34 and 36 of the retainer 148.

As shown in FIGS. 1 and 2, a conventional coupler 186 may be configured to releasably couple the plug housing 16 with the jack housing 24. More particularly, a catch 188 supported by the jack housing 24 may be positioned within an opening 190 supported by the plug housing 16 to secure together the jack assembly 14 and the plug assembly 12.

The invention claimed is:

1. An electrical connector assembly comprising:

a jack housing including a first outer side, a second outer side, and an axial passageway configured to receive an electrical connector jack;

a plug housing including a first outer side, a second outer side, and an axial passageway configured to receive an electrical connector plug for mating with the electrical connector jack;

a retainer including a first leg, a second leg, and a bridge member connecting the first leg and the second leg;

a first coupler supported by the jack housing and configured to releasably couple the retainer to the jack housing; the first couple including a first latch supported by the first outer side of the jack housing and a second latch supported by the second outer side of the jack housing; and a second coupler supported by the plug housing and configured to releasably couple the retainer to the plug housing, the second coupler including a first latch supported by the first outer side of the plug housing and a second latch supported by the second outer side of the plug housing, wherein the retainer may be alternatively coupled to the jack housing and the plug housing.

2. The electrical connector assembly of claim 1, wherein the retainer further includes a clip receiver configured to retain a supporting clip.

3. The electrical connector assembly of claim 2, wherein the clip receiver of the retainer includes a channel configured to slidably receive the supporting clip.

4. The electrical connector assembly of claim 3, wherein the channel includes a first end open to slidably receive the supporting clip, and a second end having a latch configured to be received within an aperture formed in the supporting clip.

5. The electrical connector assembly of claim 1, wherein:

the first outer side of the jack housing includes a first recess configured to receive the first leg of the retainer, and the second outer side of the jack housing includes a second recess configured to receive the second leg of the retainer; and the first outer side of the plug housing includes a first recess configured to receive the first leg of the retainer, and the second outer side of the plug housing includes a second recess configured to receive the second leg of the retainer.

6. The electrical connector assembly of claim 1, wherein the retainer further includes an engagement surface extending from the bridge member and configured to engage one of the electrical connector jack and the electrical connector plug for restricting axial movement thereof.

7. The electrical connector assembly of claim 6, wherein the engagement surface is defined by an arcuate lock positioned intermediate the first leg and the second leg.

8. An electrical connector assembly comprising:

a housing including an axial passageway and a transverse passageway;

an electrical connector configured to be received within the axial passageway, the electrical connector including a shell having a shoulder; and a retainer releasably coupled to the housing, the retainer including a clip receiver positioned exterior of said housing and configured to retain a supporting clip, wherein the retainer includes a first leg, a second leg, and a bridge member connecting the first leg and the second leg, and the clip receiver is supported by the bridge member and includes a channel configured to slidably receive the supporting clip and a lock configured to be received within the transverse passageway and to engage the shoulder of the electrical connector for restricting axial movement of the electrical connector relative to the housing.

9. The electrical connector assembly of claim 8, wherein the housing includes one of a jack housing and a plug housing, and the electrical connector includes one of an electrical connector jack configured to be received within the axial passageway of the jack housing, and an electrical connector plug configured to be received within the axial passageway of the plug housing and to mate with the electrical connector jack.

10. The electrical connector assembly of claim 8, further comprising a coupler supported by the housing and configured to releasably couple the retainer to the housing.

11. The electrical connector assembly of claim 10, wherein the coupler comprises a first latch configured to be received within a first aperture formed in the retainer, and a second latch configured to be received within a second aperture formed within the retainer.

12. The electrical connector assembly of claim 8, wherein the lock includes an arcuate surface positioned intermediate the first leg and the second leg.

* * * * *